US005574005A

United States Patent [19]

Welch et al.

[11] Patent Number: 5,574,005

[45] Date of Patent: Nov. 12, 1996

[54] PROCESS FOR PRODUCING DETERGENT AGGLOMERATES FROM HIGH ACTIVE SURFACTANT PASTES HAVING NON-LINEAR VISCOELASTIC PROPERTIES

[75] Inventors: Robert G. Welch, Cincinnati; David N. Githuku, Mason, both of Ohio; Lester J. Hollihan, Alexandria, Ky.; Charles A. Jackson, Fayetteville, Ohio

[73] Assignee: The Procter & Gamble Company, Cincinnati, Ohio

[21] Appl. No.: 399,790

[22] Filed: Mar. 7, 1995

[51] Int. Cl.[6] ..... C11D 11/00

[52] U.S. Cl. ..... 510/444; 510/446; 510/509; 510/511; 264/117; 264/140; 23/313 R

[58] Field of Search ..... 252/89.1, 174.14, 252/174, 135, 537, 556; 264/117, 140; 23/313 R

[56] References Cited

U.S. PATENT DOCUMENTS

| | | | |
|---|---|---|---|
| 3,867,316 | 2/1975 | Frank et al. | 252/545 |
| 4,384,978 | 5/1983 | Ploog et al. | 252/353 |
| 4,435,317 | 3/1984 | Gerritsen et al. | 252/547 |
| 4,482,470 | 11/1984 | Reuter et al. | 252/162 |
| 4,487,710 | 12/1984 | Kaminsky | 252/546 |
| 4,692,271 | 9/1987 | Messenger et al. | 252/354 |
| 4,919,847 | 4/1990 | Barletta et al. | 252/558 |
| 5,108,646 | 4/1992 | Beerse et al. | 252/174.25 |
| 5,133,924 | 7/1992 | Appel et al. | 264/342 R |
| 5,160,657 | 11/1992 | Bortolotti et al. | 252/174.14 |
| 5,205,958 | 4/1993 | Swatling et al. | 252/174.13 |
| 5,354,493 | 10/1994 | Wilms | 252/174.21 |
| 5,366,652 | 11/1994 | Capeci et al. | 252/89.1 |

FOREIGN PATENT DOCUMENTS

| | | |
|---|---|---|
| 0 110 731 A2 | 6/1984 | European Pat. Off. . |
| 0 351 937 A1 | 1/1990 | European Pat. Off. . |
| 0 402 112 A2 | 12/1990 | European Pat. Off. . |
| 0 402 112 A3 | 12/1990 | European Pat. Off. . |
| 0 451 894 A1 | 10/1991 | European Pat. Off. . |
| 0 504 986 A2 | 9/1992 | European Pat. Off. . |
| 0 508 543 A1 | 10/1992 | European Pat. Off. . |
| 60-072999A | 4/1985 | Japan . |
| 61-118500A | 6/1986 | Japan . |
| 1 517 713 | 7/1978 | United Kingdom . |
| WO92/01036 | 1/1992 | WIPO . |
| WO92/02609 | 2/1992 | WIPO . |
| WO92/18602 | 10/1992 | WIPO . |
| WO93/18123 | 9/1993 | WIPO . |

*Primary Examiner*—Paul Lieberman
*Assistant Examiner*—Lorna M. Douyon
*Attorney, Agent, or Firm*—Ken K. Patel; Jacobus C. Rasser; Jerry J. Yetter

[57] ABSTRACT

A process for preparing detergent agglomerates for a detergent composition is provided. The process comprises the steps of: (a) providing a non-linear viscoelastic surfactant paste including, by weight of the surfactant paste, from about 70% to 95% of a detersive surfactant and from about 5% to about 30% of water; (b) regulating the amount of sodium carbonate in the surfactant paste such that the surfactant paste has a Maximum Shear Rate of at least 20 $sec^{-1}$ so that the surfactant paste is processable; (c) charging the surfactant paste into a high speed mixer/densifier; (d) inputting from about 1% to about 70% by weight of a detergency builder into the high speed mixer/densifier; and (e) agglomerating the surfactant paste and the builder by treating the surfactant paste and the builder initially in the high speed mixer/densifier and subsequently in a moderate speed mixer/densifier so as to form detergent agglomerates.

12 Claims, 2 Drawing Sheets

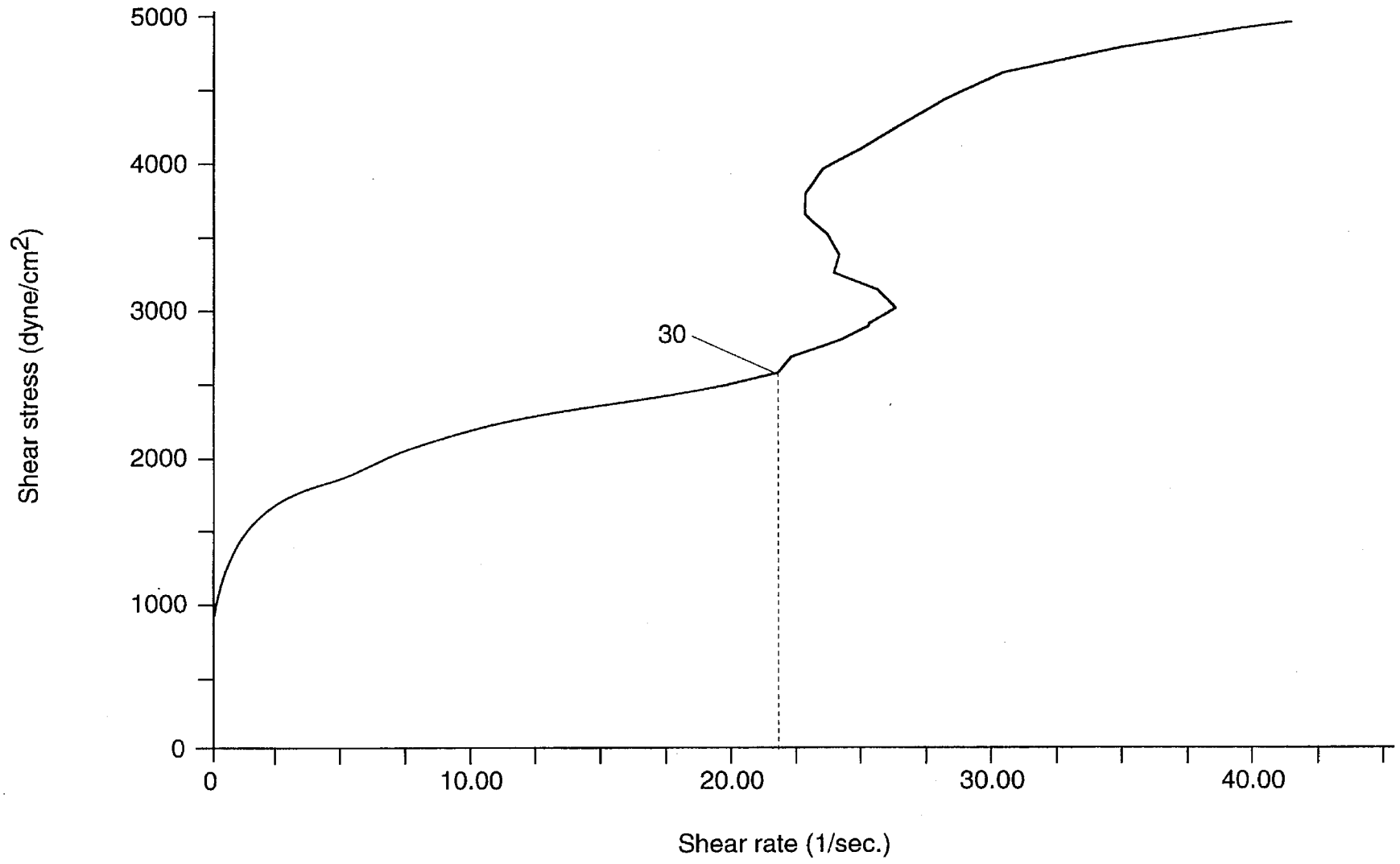
Shear stress (dyne/cm2)
5000
4000
3000
2000
1000
0
0
10.00
20.00
30.00
40.00
Shear rate (1/sec.)
30

PROCESS FOR PRODUCING DETERGENT AGGLOMERATES FROM HIGH ACTIVE SURFACTANT PASTES HAVING NON-LINEAR VISCOELASTIC PROPERTIES

FIELD OF THE INVENTION

The present invention generally relates to a process for producing detergent agglomerates suitable for use as a detergent composition or as an admix component for a fully formulated composition. More specifically, the process produces high density detergent agglomerates from a highly non-linear viscoelastic, aqueous surfactant paste which are especially difficult to process. The process involves regulating the level of sodium carbonate in the high active surfactant paste in a manner which renders it unexpectedly easier to handle, pump and process in large-scale detergent manufacturing facilities.

BACKGROUND OF THE INVENTION

Recently, there has been considerable interest within the detergent industry for laundry detergents which are "compact" and therefore, have low dosage volumes. To facilitate production of these so-called low dosage detergents, many attempts have been made to produce high bulk density detergents, for example with a density of 650 g/l or higher. The low dosage detergents are currently in high demand as they conserve resources and can be sold in small packages which are more convenient for consumers.

Generally, there are two primary types of processes by which detergent granules or powders can be prepared. The first type of process involves spray-drying an aqueous detergent slurry in a spray-drying tower to produce highly porous detergent granules. In the second type of process, various detergent components are mixed after which they are agglomerated with a nonionic or anionic detergent paste that also serves as the binder for the agglomerated particle itself. In both processes, the most important factors which govern the density of the resulting detergent granules are the density, porosity and surface area of the various starting materials and their respective chemical composition. These parameters, however, can only be varied within a limited range. Thus, a substantial bulk density increase can only be achieved by additional processing steps which lead to densification of the detergent granules.

The art is replete with processes directed primarily to densifying or otherwise processing spray dried granules. Currently, the relative amounts and types of materials subjected to spray drying processes in the production of detergent granules has been limited. For example, it has been difficult to attain high levels of surfactant in the resulting detergent composition, a feature which facilitates production of low dosage detergents. Thus, those skilled in the art have striven for ways in which detergent compositions can be produced without having the limitations imposed by conventional spray drying techniques. To that end, the art is also replete with disclosures of processes which entail agglomerating detergent compositions. For example, attempts have been made to agglomerate detergent builders by mixing zeolite and/or layered silicates in a mixer to form free flowing agglomerates. While such attempts suggest that their process can be used to produce detergent agglomerates, they do not provide a mechanism by which starting detergent materials in the form of highly active, viscoelastic surfactant pastes can be effectively agglomerated into crisp, free flowing, highly dense detergent agglomerates.

Additionally, a wide variety of problems have been encountered with handling high active, high viscoelastic surfactant pastes which are particularly useful in producing high density, high active detergent agglomerates suitable for modern low dosage detergent products. Such highly viscoelastic surfactant pastes are extremely sensitive to environmental and operating equipment parameters, all of which make the pastes difficult to transport, store and process when producing detergent agglomerates. By way of example, high active surfactant pastes typically must be kept at elevated temperatures to insure that they have a low enough viscosity to pump in and out of transport tracks or trains and in and out of storage tanks at the manufacturing facility. Any significant decreases in temperature may lead to undesirable gelling or solidification of the surfactant paste causing increases in manufacturing expenses and time. Note, however, that different rheological properties of the surfactant paste may result upon reheating.

This problem is especially exacerbated in the event that certain highly viscoelastic surfactant pastes exhibit non-linear viscoelastic properties, i.e. they exhibit elastic or "rubbery" flow properties during processing. The predictability of flow behavior of non-linear viscoelastic fluids is known to be very difficult. The unpredictability of flow behavior of such fluids lends itself to problems with handling and processing on a large-scale detergent manufacturing context. In the large-scale manufacturing context, a major problem with surfactant pastes that exhibit non-linear viscoelastic flow properties occurs when such pastes are pumped through equipment having complex geometries and/or converging and diverging sections, e.g. heat exchangers and manifolds converging into spray nozzles, during which pressure relief pins are blown causing undesirable shut-down time in the process.

Also in that regard, a high active viscoelastic paste requires an additional amount or buffer amount of carbonate and/or hydroxide so as to maintain the storage and transport stability of the surfactant paste before it is processed into a detergent product. However, the additional carbonate and/or hydroxide has the effect of increasing the viscoelasticity of the high active surfactant paste, therefore rendering it very difficult to process. The difficulty in processing arises due to a change in the viscoelasticity of the surfactant paste which requires relatively expensive high-pressure pumps, larger pipe lines and shorter transport distances to be implemented into the detergent-making process. As a consequence, it would be desirable to have a process in which the storage stability of the paste is maintained without sacrificing the its processability.

Accordingly, despite the above-mentioned disclosures in the art, there remains a need for a process by which high density detergent agglomerates can be effectively produced from a highly viscous and highly non-linear viscoelastic, aqueous surfactant paste. Also, there remains a need for such a process which is inexpensive and can be easily incorporated into large-scale production facilities for low dosage or compact detergents.

BACKGROUND ART

The following references are directed to surfactant pastes: Aouad et al, WO 93/18123 (Procter & Gamble), Aouad et al, WO 92/18602 (Procter & Gamble), Aouad et al, EP 508,543 (Procter & Gamble) and Van Zorn et al, EP 504,986 (Shell). The following references are directed to densifying spray-dried granules: Appel et al, U.S. Pat. No. 5,133,924 (Lever);

Bortolotti et al, U.S. Pat. No. 5,160,657 (Lever); Johnson et al, British patent No. 1,517,713 (Unilever); and Curtis, European Patent Application 451,894. The following references are directed to producing detergents by agglomeration: Beerse et al, U.S. Pat. No. 5,108,646 (Procter & Gamble); Hollingsworth et al, European Patent Application 351,937 (Unilever); and Swatling et al, U.S. Pat. No. 5,205,958.

SUMMARY OF THE INVENTION

The present invention meets the needs identified above by providing a process for making high density detergent agglomerates in which the pumpability or handling capabilities of a highly active and highly non-linear viscoelastic surfactant paste is maintained. Unexpectedly, it has been found that by regulating or otherwise controlling the amount of carbonate used in the paste, the paste can be maintained above a Maximum Shear Rate value as defined and measured hereinafter such that it can be processed easily and effectively through large-scale manufacturing equipment. It has been found that any processing of the surfactant paste with the selected Maximum Shear Rate (i.e. below about 20 $sec^{-1}$) of the surfactant pastes described herein is extremely difficult.

As used herein, the term "agglomerates" refers to particles formed by agglomerating detergent granules or particles which typically have a smaller mean particle size than the formed agglomerates. All documents referenced herein are incorporated by reference and all percentages used herein are expressed as "percent-by-weight" unless indicated otherwise.

In accordance with one aspect of the invention, a process for producing high density detergent agglomerates is provided. The process comprises the steps of: (a) providing a non-linear viscoelastic surfactant paste including, by weight of the surfactant paste, from about 70% to 95% of a detersive surfactant and from about 5% to about 30% of water; (b) regulating the amount of sodium carbonate in the surfactant paste such that the surfactant paste has a Maximum Shear Rate of at least 20 $sec^{-1}$ so that the surfactant paste is processable; (c) charging the surfactant paste into a high speed mixer/densifier; (d) inputting from about 1% to about 70% by weight of a detergency builder into the high speed mixer/densifier; and (e) agglomerating the surfactant paste and the builder by treating the surfactant paste and the builder initially in the high speed mixer/densifier and subsequently in a moderate speed mixer/densifier so as to form detergent agglomerates.

In accordance with another aspect of the invention, a preferred embodiment of the process is provided. This process comprising the steps of: (a) providing a non-linear viscoelastic surfactant paste including, by weight of the surfactant paste, from about 70% to 95% of a detersive surfactant, and from about 5% to about 30% of water, wherein the detergent surfactant is mixture of alkyl sulfate and linear alkylbenzene sulfonate surfactants in a weight ratio of about 3:1; (b) regulating the amount of sodium carbonate in the surfactant paste such that the surfactant paste has a Maximum Shear Rate of from about 85 to 130 $sec^{-1}$ so that the surfactant paste is processable; (c) charging the surfactant paste into a high speed mixer/densifier; (d) inputting from about 1% to about 70% by weight of a detergency builder into the high speed mixer/densifier; and (e) agglomerating the surfactant paste and the builder by treating the surfactant paste and the builder initially in the high speed mixer/densifier and subsequently in a moderate speed mixer/densifier so as to form detergent agglomerates.

The invention also provides a detergent product containing detergent agglomerates produced according to any of the processes described herein.

Accordingly, it is an object of the invention to provide a process for effectively processing high active, nonlinear viscoelastic surfactant pastes and other starting detergent ingredients directly to high density detergent agglomerates. It is also an object of the invention to provide such a process which is inexpensive and can be easily incorporated into large-scale production facilities for low dosage or compact detergents. These and other objects, features and attendant advantages of the present invention will become apparent to those skilled in the art from a reading of the following detailed description of the preferred embodiment and the appended claims.

BRIEF DESCRIPTION OF THE DRAWING

FIG. 2 is a graphical plot of shear stress versus shear rate for the surfactant paste presented in Example I and illustrates the determination of its Maximum Shear Rate.

DETAILED DESCRIPTION OF THE PREFERRED EMBODIMENT

Figure 1:
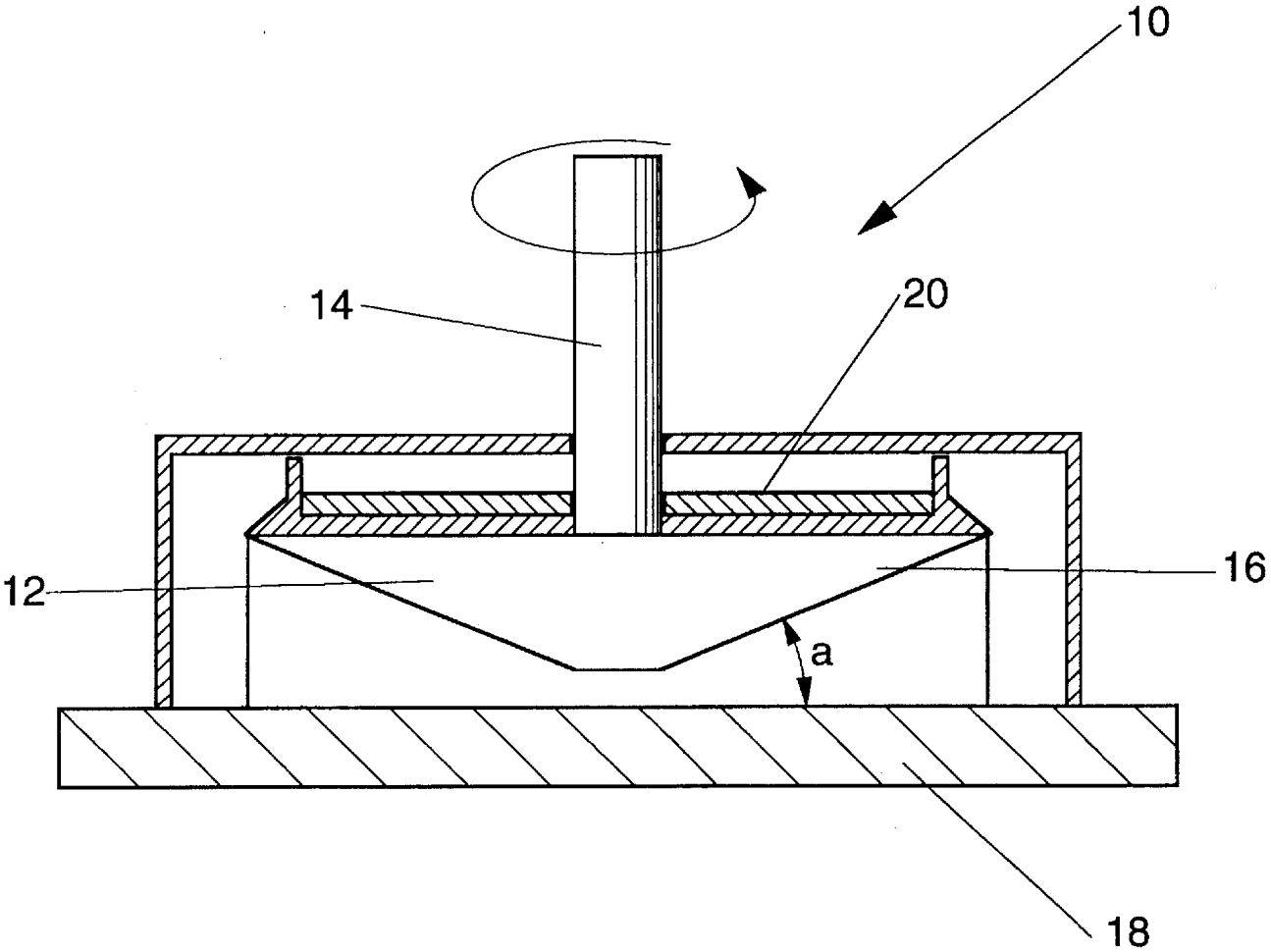
FIG. 1 is a partial side-view of a controlled stress rheometer used to determine the Maximum Shear Rate in accordance with the invention.

The present invention is directed to a process which produces free flowing, high density detergent agglomerates, preferably having a density of at least 650 g/l. The process produces high density detergent agglomerates from a highly viscoelastic surfactant paste having a relatively low water content. In the past, processing of certain highly viscoelastic, high active surfactant pastes has been a problem, especially through equipment having complex geometries, e.g. heat exchangers, manifolds converging into several spray nozzles and the like. It has been unexpectedly found that such surfactant pastes exhibit nonlinear viscoelastic fluid properties characterized by a Maximum Shear Rate or "shear fracture" point as determined herein. In the instant process, surfactant pastes having a Maximum Shear Rate value as measured herein below about 20 $sec^{-1}$ are difficult to process in that they require relatively expensive process equipment such as high-pressure pumps, large diameter pipelines and short transport distances. By selecting surfactant pastes with the aforementioned Maximum Shear Rate, the process does not experience shut-down time as a result of processing highly nonlinear viscoelastic pastes through the complex detergent-making equipment required for modern compact detergent products, and does not require additional expensive process equipment.

Generally, the present process is used in the production of low dosage detergents whereby the resulting detergent agglomerates can be used as a detergent or as a detergent additive. In particular, the process can be used to form "high active" (i.e. high surfactant level) detergent agglomerates which are used as au admix for purposes of enhancing the active levels in granular low dosage detergents and thereby allow for more compact detergents.

PROCESS

In the first step of the process, a non-linear viscoelastic surfactant paste is provided which are characteristic of many highly active, highly viscoelastic pastes used in producing high density detergent agglomerates. The phrase "nonlinear viscoelastic" means that the paste has a nonlinear fluid velocity profile and exhibits viscoelastic fluid behavior, i.e. it can be stretched during flow such as chewing gum or the like. Until now, such nonlinear viscoelastic surfactant pastes are very difficult to process. Preferably, the surfactant paste comprises, by weight of the surfactant paste, from about 70% to about 95%, more preferably from about 70% to about 85%, and most preferably from about 70% to about 75%, of a detersive surfactant. In a preferred embodiment, the surfactant paste is a mixture of alkyl sulfate ("AS") and linear alkylbenzene sulfonate ("LAS") surfactants in a weight ratio of from about 1:1 to about 5:1 (AS:LAS). Another preferred embodiment herein contemplates a surfactant paste mixture having a weight ratio of alkyl sulfate to linear alkylbenzene sulfonate of about 3:1. Other optional surfactant systems include pure AS or pure LAS surfactants in the paste as well as alkyl ethoxy sulfate ("AES") systems in which AES is the sole or one of the surfactants in the paste.

The surfactant paste also includes from about 5% to about 30%, more preferably from about 15% to about 25%, and most preferably from about 15% to about 20%, by weight of the paste, of water. Additionally, the paste includes from about 0.1% to about 10%, more preferably from about 1% to about 5%, and most preferably from about 2% to about 4%, by weight of the paste, of polyethylene glycol. The surfactant paste also contains from about 0.01% to about 5%, more preferably from about 0.1% to about 0.8%, and most preferably from about 0.3% to about 0.5%, by weight of the paste, of sodium hydroxide. Also included in the surfactant paste are minor ingredients such as unreacted acids, sulfates and the like.

Another step of the process involves regulating the amount of sodium carbonate in the surfactant paste such that the paste has a Maximum Shear Rate of at least 20 $sec^{-1}$, more preferably from about 40 $sec^{-1}$ to about 180 $sec^{-1}$, and most preferably from about 85 $sec^{-1}$ to about 130 $sec^{-1}$ so that the surfactant paste is processable. The Maximum Shear Rate is discussed more fully hereinafter. In this regard, the level of sodium carbonate will typically be from about 0% or 0.01% to about 5%, more typically from about 0.1% to about 0.9%, and most preferably from about 0.1% to about 0.6%. This step can be performed before, during or after the neutralization of the anionic surfactant acid used to produce the surfactant paste. Preferably, this regulating step is completed during the neutralization process for providing the surfactant paste.

In the next step of the process, the surfactant paste is charged into a high speed mixer/densifier (e.g. Lödige Recycler CB 30 to CB 100). In this step, from about 25% to about 65%, more preferably 30% to about 60%, and most preferably from about 35% to about 55%, by weight of the surfactant paste, is used in the process to make the agglomerates. Also, from about 1% to about 70%, more preferably from about 5% to about 70% and, most preferably from about 50% to about 70%, by weight of a detergency builder is inputted into the high speed mixer/densifier. Although other builders can be used in the process as described hereinafter, aluminosilicate builder is the preferred. The surfactant paste and the builder are agglomerated by treating the paste and the builder initially in the high speed mixer/densifier and subsequently in a moderate speed mixer/densifier (e.g. Lödige Recycler KM 300 to KM 15,000 "Ploughshare") so as to form detergent agglomerates. Other equipment suitable for use as the high speed mixer/densifier or moderate speed mixer/densifier are described in Capeci, U.S. Pat. No. 5,366,652, the disclosure of which is incorporated herein by reference. Optionally, other conventional detergent ingredients as described hereinafter can also be inputted into the high speed mixer/densifier and/or moderate speed mixer/densifier to more a fully formulated detergent agglomerate.

The surfactant paste, builder and other optional starting detergent materials are sent to a moderate speed mixer/densifier for further build-up agglomeration resulting in agglomerates having a density of at least 650 g/l and, more preferably from about 700 g/l to about 900 g/l. Preferably, the mean residence time of the surfactant paste and other starting detergent materials in the high speed mixer/densifier (e.g. Lödige Recycler CB 30 to CB 100 mixer/densifiers) is from about 1 to 30 seconds while the residence time in low or moderate speed mixer/densifier (e.g. Lödige Recycler KM 300 to KM 15,000 "Ploughshare" mixer/densifiers) is from about 0.25 to 10 minutes.

Inevitably, a certain amount of the agglomerates exiting the moderate speed mixer/densifier will be below the predetermined particle size range and optionally, can be screened and recycled back to the high speed mixer/densifier for further build-up agglomeration. In that regard, these so-called undersized agglomerates or "fines" will comprise from about 5% to about 30% by weight of the detergent agglomerates.

The detergent agglomerates produced by the process are particularly useful in the production of low dosage detergents. The particle porosity of the resulting detergent agglomerates produced according to the process of the invention is preferably in a range from about 5% to about 20%, more preferably at about 10%. The combination of the above-referenced porosity and particle size results in agglomerates having density values of 650 g/l and higher. Such a feature is especially useful in the production of low dosage laundry detergents as well as other granular compositions such as dishwashing compositions.

The process can comprise the step of spraying an additional binder in the mixer/densifier(s) used in the agglomeration step to facilitate production of the desired detergent agglomerates. A binder is added for purposes of enhancing agglomeration by providing a "binding" or "sticking" agent for the detergent components. The binder is preferably selected from the group consisting of water, anionic surfactants, nonionic surfactants, polyethylene glycol, polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

Another optional step contemplated by the present process includes conditioning the detergent agglomerates by drying the detergent agglomerates after the moderate speed mixer/densifier. Yet another optional step involves adding a coating agent (e.g. aluminosilicates, carbonates, sulfates, or any other dry powdered material) to the detergent agglomerate before or after they exit the moderate speed mixer/densifier for purposes of enhancing the flowability of the agglomerates (i.e. reduce caking). This furthers enhances the condition of the detergent agglomerates for use as an additive or to place them in shippable or packagable form. Those skilled in the an will appreciate that a wide variety of methods may be used to dry as well as cool the exiting detergent agglomerates without departing from the scope of the invention. By way of example, apparatus such as a fluidized bed can be used for drying while an airlift can be used for cooling should it be necessary.

MAXIMUM SHEAR RATE

In the art of rheological properties of fluids and relative to surfactant pastes, it is known by those skilled in the art that certain surfactant pastes display viscoelastic effects or behavior. That is, while possessing the typical viscoelastic flow behavior of liquids, surfactant pastes also show concurrently the elastic response usually associated with solids. Viscoelasticity is described in terms of linear and non-linear viscoelasticity. Linear viscoelasticity is a measure of the response of an elastic liquid to such small stresses (or forces) that the liquid's microstructure does not change. At these low stress (or force) levels, there is a linear relationship between the stress (force) and the strain (displacement), thus the term linear "viscoelasticity."

If a material still possesses viscoelastic effects at very high stress levels such as those encountered in a large-scale detergent manufacturing plant, then they are the to exhibit non-linear viscoelastic effects. The relationship between the applied stress (forces) and the resulting strains (displacements) are non-linear. In addition to this, non-linear viscoelastic materials generate stresses perpendicular to the shearing direction. These stresses are commonly referred to as "normal" stresses. The higher the normal stress, the more non-linear the viscoelastic material. The viscosity profile of these non-linear viscoelastic pastes are measured on a standard "controlled stress rheometer" with a cone and plate geometry, such as one commercially available from TA Instruments, Inc., under the trade name Carri-Med CSL 100.

In the test, the surfactant paste 12 is placed between a cone 16 with a diameter of 4 cm and a cone angle a of 2°, and a heated flat plate. FIG. 1 depicts a partial side-view of the pertinent details in the controlled stress rheometer 10 where the surfactant paste 12 is contained among a rotating shaft 14, heated bottom plate. 18, and a solvent trap 20 with water. A programmed ramp in shear stress from 5 to 5000 dynes/cm$^2$ is applied over a 3 minute period and the resulting shear rate is measured. A plot of the shear stress verses shear rate is generated as a result of the aforementioned test. For the nonlinear viscoelastic surfactant paste, as the shear stress increases, normal stresses are generated which attempt to separate the cone and plate in the rheometer. Since this cannot occur by virtue of the strength of such stresses, the only relief for the paste is to exit out of the gap formed between the cone and plate in the rheometer. When this occurs, the shear stress verses shear rate plot becomes irregular (erratic or irregular increases in values) and it is at this point that is referenced herein as the Maximum Shear Rate or "shear fracture" point.

If the Maximum Shear Rate occurs at a low shear rate on the plot, e.g. below 20 sec$^{-1}$, this means that the paste has greater non-linear viscoelastic properties. Such a surfactant paste will be very difficult to process in complex equipment such as heat exchangers with converging and diverging sections and through equipment with pressure relief pins. Surfactant pastes with high Maximum Shear Rate values have a lower degree of non-linear viscoelastic fluid properties which are not severe enough to make processing difficult in a large-scale commercial detergent-making facility such as that required by the instant process. This method of determining the Maximum Shear Rate for a fluid is also described in *Introduction to Rheology*, Barnes et al, Elsevier Science Publishers (Netherlands), 1989, the disclosure of which is incorporated herein by reference.

SURFACTANT PASTE

The viscoelastic surfactant paste used herein has viscoelastic fluid properties which can be described by a commonly used mathematical model that accounts for the shear thinning nature of the paste. The mathematical model is called the Power Law Model and is described by the following relation:

$$\sigma=K\gamma^n$$

where $\sigma$=Shear Stress (dynes/cm$^2$), K=Consistency (Poise.sec$^{n-1}$), $\gamma$=Shear Rate (sec$^{-1}$), and n=Rate Index (dimensionless). The rate index n varies from 0 to 1. The closer n is to 0, the more shear thinning the fluid. The closer n is to 1, the closer it is to simple Newtonian behavior, i.e. constant viscosity behavior. K can be interpreted as the apparent viscosity at a shear rate of 1 sec$^{-1}$.

In this context, the viscoelastic surfactant paste used in the process has a consistency K at 70° C. of from about 50,000 to about 250,000 cPoise.sec$^{n-1}$ (500 to 2,500 Poise.sec$^{n-1}$), more preferably from about 100,000 to about 195,000 cPoise.sec$^{n-1}$ (1,000 to 1,950 Poise.sec$^{n-1}$), and most preferably from about 120,000 to about 180,000 cPoise.sec$^{n-1}$ (1,200 to 1,800 Poise.sec$^{n-1}$). Preferably, the surfactant paste has a shear index n of from about 0.05 to about 0.25, more preferably from about 0.08 to about 0.20 and most preferably from about 0.10 to about 0.15.

The surfactant in the paste can be selected from anionic, nonionic, zwitterionic, ampholytic and cationic classes and compatible mixtures thereof. Detergent surfactants useful herein are described in U.S. Pat. No. 3,664,961, Norris, issued May 23, 1972, and in U.S. Pat. No. 3,919,678, Laughlin et al., issued Dec. 30, 1975, both of which are incorporated herein by reference. Useful cationic surfactants also include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference. Of the surfactants, anionics and nonionic are preferred and anionics are most preferred.

The following are representative examples of detergent surfactants useful in the present surfactant paste. Water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional anionic surfactants which suitable for use herein include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{8-18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially valuable are linear straight chain alkylbenzene sulfonates in which the average number of carbon atoms in the alkyl group is from about 11 to 13, abbreviated as $C_{11-13}$ LAS.

Other anionic surfactants suitable for use herein are the sodium alkyl glyceryl ether sulfonates, especially those ethers of higher alcohols derived from tallow and coconut oil; sodium coconut oil fatty acid monoglyceride sulfonates and sulfates; sodium or potassium of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

In addition, suitable anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxyalkane-1-sulfonic acids containing from about 2 to 9 carbon atoms in the acyl group and from about 9 to about 23 carbon atoms in the alkane moiety; water-soluble salts of olefin and paraffin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Preferred anionic surfactants are $C_{10-18}$ linear alkylbenzene sulfonate and $C_{10-18}$ alkyl sulfate. If desired, low moisture (less than about 25% water) alkyl sulfate paste can be the sole ingredient in the surfactant paste. Most preferred are $C_{10-18}$ alkyl sulfates, linear or branched, and any of primary, secondary or tertiary. A preferred embodiment of the present invention is wherein the surfactant paste comprises from about 20% to about 40% of a mixture of sodium $C_{10-13}$ linear alkylbenzene sulfonate and sodium $C_{12-16}$ alkyl sulfate in a weight ratio of about 2:1 to 1:2. Another preferred embodiment of the detergent composition includes a mixture of $C_{10-18}$ alkyl sulfate and $C_{10-18}$ alkyl ethoxy sulfate in a weight ratio of about 80:20.

Water-soluble nonionic surfactants are also useful in the instant invention. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 12 moles of ethylene oxide per mole of alkyl phenol. Included are the water-soluble and water-dispersible condensation products of aliphatic alcohols containing from 8 to 22 carbon atoms, in either straight chain or branched configuration, with from 3 to 12 moles of ethylene oxide per mole of alcohol.

An additional group of nonionics suitable for use herein are semi-polar nonionic surfactants which include water-soluble amine oxides containing one alkyl moiety of from abut 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)_nOH$, wherein $R^1$ is a $C_{10}$-$C_{16}$ alkyl group or a $C_8$-$C_{12}$ alkyl phenyl group, and n is from 3 to about 80. Particularly preferred are condensation products of $C_{12}$-$C_{15}$ alcohols with from about 5 to about 20 moles of ethylene oxide per mole of alcohol, e.g., $C_{12}$-$C_{13}$ alcohol condensed with about 6.5 moles of ethylene oxide per mole of alcohol.

Additional suitable nonionic surfactants include polyhydroxy fatty acid amides of the formula

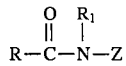

wherein R is a $C_{9-17}$ alkyl or alkenyl, $R_1$ is a methyl group and Z is glycityl derived from a reduced sugar or alkoxylated derivative thereof. Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798, the disclosures of which are incorporated herein by reference.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present invention. Cationic surfactants comprise a wide variety of compounds characterized by one or more organic hydrophobic groups in the cation and generally by a quaternary nitrogen associated with an acid radical. Pentavalent nitrogen ring compounds are also considered quaternary nitrogen compounds. Suitable anions are halides, methyl sulfate and hydroxide. Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980, incorporated herein by reference.

Cationic surfactants are often used in detergent compositions to provide fabric softening and/or antistatic benefits. Antistatic agents which provide some softening benefit and which are preferred herein are the quaternary ammonium salts described in U.S. Pat. No. 3,936,537, Baskerville, Jr. et al., issued Feb. 3, 1976, the disclosure of which is incorporated herein by reference.

DETERGENCY BUILDER

The starting detergent ingredients of the present process can, and preferably do, also comprise a detergent builder. Builders are generally selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above. Preferred for use herein are the phosphates, carbonates, silicates, $C_{10-18}$ fatty acids, polycarboxylates, and mixtures thereof. More preferred are sodium tripolyphosphate, tetrasodium pyrophosphate, citrate, tartrate mono- and di-succinates, sodium silicate, and mixtures thereof (see below).

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorous, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid. Some of these materials are useful as the water-soluble anionic polymer as hereinafter described, but only if in intimate admixture with the non-soap anionic surfactant.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Water-soluble silicate solids represented by the formula $SiO_2.M_2O$, M being an alkali metal, and having a $SiO_2:M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized, as well.

OPTIONAL DETERGENT COMPONENTS

The starting or entering detergent components in the present process can also include any number of additional ingredients. These include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and No. 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

In order to make the present invention more readily understood, reference is made to the following examples, which are intended to be illustrative only and not intended to be limiting in scope.

EXAMPLE I

This Example illustrates measurement of the Maximum Shear Rate of a surfactant paste within the scope of invention. A surfactant paste composition having the components and relative proportions is set forth in Table I below:

TABLE I

| Component | % Weight |
|---|---|
| $C_{14-15}$ alkyl sulfate | 56.5 |
| $C_{12-13}$ linear alkylbenzene sulfonate | 18.8 |
| Polyethylene glycol | 3.7 |
| Sodium carbonate | 1.0 |
| Water | 18.5 |
| Minors (sulfate, unreacted, etc.) | 1.5 |
| | 100.00 |

The surfactant paste in Table I is placed in a "cone and plate" rheometer purchased commercially from TA Instruments. Inc. under the tradename Carimed. At a cone angle of 2° and a cone radius of 2 cm, the shear stress (dynes/$cm^2$) is applied and the shear rate ($sec^{-1}$) is measured and graphically depicted (alternatively they could be tabulated). The results of the applied shear rate and shear stress measurement are set forth in FIG. 2. As can be seen in FIG. 2, an irregular increase in shear rate occurs at the 22 $sec^{-1}$ point. The irregularity indicates all obvious fracture or nonuniform increase in the shear stress and shear rate. This is the Maximum Shear Rate 30 or critical shear rate as used herein for the surfactant paste in Table I.

EXAMPLE II

This Example illustrates several surfactant pastes and the effect various levels of sodium carbonate have on the Maximum Shear Rate of the paste. Six surfactant pastes having the identical compositions except that the level of sodium carbonate varies are measured for their Maximum Shear Rate in accordance with Example I. The results are set forth in Table II below.

TABLE II

| | (% weight) | | | | | |
|---|---|---|---|---|---|---|
| Component | A | B | C | D | E | F |
| $C_{14-15}$ alkyl sulfate | 55.5 | 55.5 | 55.5 | 55.5 | 55.5 | 55.5 |
| $C_{12-13}$ linear alkylbenzene sulfonate | 18.5 | 18.5 | 18.5 | 18.5 | 18.5 | 18.5 |
| Polyethylene glycol | 3.8 | 3.8 | 3.8 | 3.8 | 3.8 | 3.8 |
| Sodium hydroxide | 0.5 | 0.5 | 0.5 | 0.5 | 0.5 | 0.5 |
| Sodium carbonate | 0.0 | 0.5 | 0.6 | 2.0 | 1.1 | 1.2 |
| Water | 18.5 | 18.5 | 18.5 | 18.5 | 18.5 | 18.5 |
| Minors (sulfate, unreacted, etc.) | 3.2 | 2.7 | 2.6 | 1.2 | 2.1 | 2.0 |
| | 100.0 | 100.0 | 100.0 | 100.0 | 100.0 | 100.0 |
| Maximum Shear Rate ($sec^{-1}$) | 127 | 100 | 86 | 4.6 | 7 | 10 |

As call be seen from the results in Table II (processing/analytical error ±2–3%), increasing the level of sodium carbonate unexpectedly results in decreasing Maximum Shear Rate values. In separate runs, each of the surfactant pastes A–F are then charged to a high speed mixer/densifier ("Pin Mixer" purchased from Processall, Inc.). The high speed mixer/densifier includes a 20.3 cm diameter horizontal rotating shaft (19.3 cm length, 1100 rpm) with 16 pins (1.3 cm diameter, 9.2 cm length) equally spaced on four rows on 90° centers and a 5.8 mm space between the pins and the mixer/densifier wall (jacket temperature 37° C.). Initially, the aluminosilicate, and other starting dry detergent ingredients are inputted into the aforementioned high speed mixer/densifier. In each run, the surfactant paste compositions are charged at a rate of 32.5 g/see (71° C.) to the high speed mixer/densifer for a residence time of about 12 seconds. Thereafter, a total of about 300 grams from the high speed mixer/densifier is fed into a moderate speed mixer/densifier (Tilt-A-Mixer™, Model 4 HV commercially available from Processall, Inc.). The moderate speed mixer/densifier (jacket temperature 37° C.) has a shaft speed of 200 rpm and a residence time of 4 minutes.

While surfactant pastes A, B and C (with Maximum Shear Rates above 20 $sec^{-1}$) are successfully used to produce detergent agglomerates pursuant to the current invention, surfactant pastes D, E, and F have Maximum Shear Rate values well below 20 $sec^{-1}$ and are extremely difficult to use in the current process. The result illustrates the unexpected benefit of processing surfactant pastes exhibiting certain Maximum Shear Rates (i.e. above 20 $sec^{-1}$).

Having thus described the invention in detail, it will be clear to those skilled in the art that various changes may be made without departing from the scope of the invention and the invention is not to be considered limited to what is described in the specification.

What is claimed is:

1. A process for preparing detergent agglomerates comprising the steps of:

(a) providing a non-linear viscoelastic surfactant paste including, by weight of said surfactant paste, from about 70% to 95% of a detersive surfactant and from about 5% to about 30% of water, wherein said surfactant paste is a shear thinning paste meeting the following relation $$\sigma=K\gamma^n$$

where σ=Shear Stress (dynes/$cm^2$), K is a Consistency value of from about 50,000 to about 250,000 cPoise.$sec^{n-1}$, γ=Shear Rate ($sec^{-1}$), and n=Rate Index varying from about 0.05 to about 0.25;

(b) regulating the amount of sodium carbonate within the range from about 0.01% to about 0.6% by weight in said surfactant paste such that said surfactant paste has a Maximum Shear Rate of from about 40 $sec^{n-1}$ to about 180 $sec^{-1}$ so that said surfactant paste is processable;

(c) charging said surfactant paste into a high speed mixer/densifier;

(d) inputting from about 1% to about 70% by weight of aluminosilicate into said high speed mixer/densifier; and (e) agglomerating said surfactant paste and said aluminosilicate by treating said surfactant paste and said aluminosilicate initially in said high speed mixer/densifier and subsequently in a moderate speed mixer/densifier so as to form said detergent agglomerates.

2. The process of claim 1 wherein said detersive surfactant is a mixture of alkyl sulfate and linear alkylbenzene sulfonate surfactants in a weight ratio of from about 1:1 to about 5:1.

3. The process of claim 1 further comprising the step of drying said detergent agglomerates.

4. The process of claim 1 wherein the residence time of said surfactant paste and said builder in said high speed mixer/densifier is from about 1 seconds to about 30 seconds and in said moderate speed mixer/densifier of from about 0.25 minutes to about 10 minutes.

5. The process of claim 1 wherein said surfactant paste also includes from about 0.1% to about 10% of polyethylene glycol.

6. The process of claim 1 wherein said surfactant paste includes from about 15% to about 25% of said water.

7. The process of claim 1 further comprising the step of adding a coating agent to said detergent agglomerates after exiting said moderate speed mixer/densifier.

8. A process for preparing detergent agglomerates comprising the steps of:

(a) providing a non-linear viscoelastic surfactant paste including, by weight of said surfactant paste, from about 70% to 95% of a detersive surfactant, and from about 5% to about 30% of water, wherein said detergent surfactant is mixture of alkyl sulfate and linear alkylbenzene sulfonate surfactants in a weight ratio of about 3:1, and said surfactant paste is a shear thinning paste meeting the following relation $$\sigma=K\gamma^n$$

where σ=Shear Stress (dynes/$cm^2$), K is a Consistency value of from about 50,000 to about 250,000 cPoise.$sec^{n-1}$, $\gamma$=Shear Rate ($sec^{n-1}$), and n=Rate Index varying from about 0.05 to about 0.25;

(b) regulating the amount of sodium carbonate within the range from about 0.01% to about 0.6% by weight in said surfactant paste such that said surfactant paste has a Maximum Shear Rate of from about 85 to 130 $sec^{-1}$ so that said surfactant paste is processable;

(c) charging said surfactant paste into a high speed mixer/densifier;

(d) inputting from about 1% to about 70% by weight of aluminosilicate into said high speed mixer/densifier; and (e) agglomerating said surfactant paste and said aluminosilicate by treating said surfactant paste and said aluminosilicate initially in said high speed mixer/densifier and subsequently in a moderate speed mixer/densifier so as to form said detergent agglomerates.

9. The process of claim 8 wherein said surfactant paste also includes from about 0.3% to about 0.5%, by weight of said surfactant paste, of sodium hydroxide.

10. The process of claim 8 wherein said surfactant paste also includes from about 2% to about 4% by weight of said surfactant paste, of polyethylene glycol.

11. The process of claim 8 wherein said surfactant paste includes from about 70% to about 75% by weight of said detersive surfactant.

12. The process of claim 8 wherein said surfactant paste includes from about 15% to about 20% by weight of said water.

* * * * *